US005444216A

United States Patent [19]

Bouleau et al.

[11] Patent Number: 5,444,216

[45] Date of Patent: Aug. 22, 1995

[54] DISTRIBUTION CHAMBER FOR AN ELECTRIC STEAM IRON WITH TWO COMPARTMENTS SEPARATED BY A PARTITION

[75] Inventors: Jean-Paul A. A. Bouleau, Champfleur; Gerard L. H. Guillot, Radon, both of France

[73] Assignee: Moulinex (Societe Anonyme), Bagnolet, France

[21] Appl. No.: 231,300

[22] Filed: Apr. 22, 1994

[30] Foreign Application Priority Data

Apr. 23, 1993 [FR] France ..... 93 04852

[51] Int. Cl.[6] ..... D06F 75/16

[52] U.S. Cl. ..... 219/245; 38/77.83

[58] Field of Search ..... 219/245, 246, 247, 248, 219/250, 254, 255, 258, 259; 38/77.1–77.9; 392/399, 403–406

[56] References Cited

U.S. PATENT DOCUMENTS

| | | | |
|---|---|---|---|
| 3,919,793 | 11/1975 | Toft et al. . | |
| 4,550,514 | 11/1985 | Reiss et al. | 38/77.82 |
| 4,567,679 | 2/1986 | Kraft et al. | 38/77.82 |
| 4,586,277 | 5/1986 | Reiss et al. | 38/77.83 |
| 4,920,668 | 5/1990 | Henneberger et al. | 38/77.8 |

FOREIGN PATENT DOCUMENTS

| | | | |
|---|---|---|---|
| 0454048 | 10/1991 | European Pat. Off. . | |
| 0461959 | 12/1991 | European Pat. Off. . | |
| 0553065 | 7/1993 | European Pat. Off. . | |
| 2653455 | 4/1991 | France . | |
| 2800767 | 4/1979 | Germany . | |
| 60-171099 | 9/1985 | Japan | 38/77.1 |
| 61-238300 | 10/1986 | Japan | 38/77.8 |
| 2264508 | 9/1993 | United Kingdom | 38/77.6 |

*Primary Examiner*—John A. Jeffery
*Attorney, Agent, or Firm*—Young & Thompson

[57] ABSTRACT

A distribution chamber (12) of an electric steam iron comprises two compartments separated in part by a partition (24) whose upper edge (20) is in sealed contact with the cover (13). A first of those compartments (26) is connected to the inlet orifice (14) of the reservoir (15) and through it passes the valve (10) of a first water injection device (11). A second of these compartments (28) communicates with the first compartment (26) through at least one throat (30) and constitutes a water reserve when the iron is used with the sole in a vertical plane. There is immersed, through the cover (13), the opening (27) of a second water injection device (21) for the second compartment (26).

8 Claims, 4 Drawing Sheets

Figure 1:
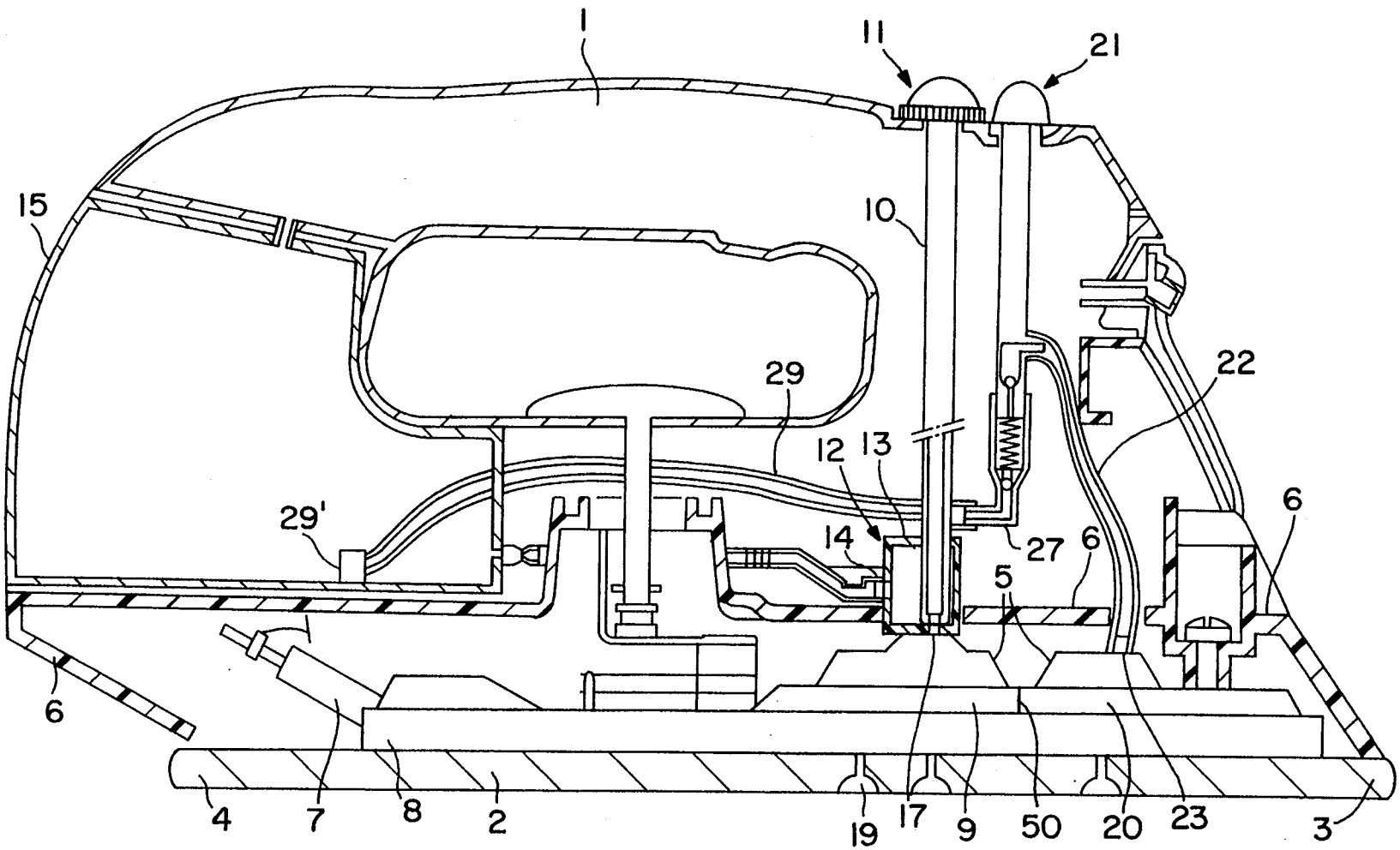
FIG. 1 PRIOR ART

DISTRIBUTION CHAMBER FOR AN ELECTRIC STEAM IRON WITH TWO COMPARTMENTS SEPARATED BY A PARTITION

The invention relates to an electric steam iron comprising a casing and a sole extending longitudinally from a point near the heel and separated from the casing by a thermal shield. The sole comprises a heating element molded into a projection and two vaporization chambers closed by a lid and separated by a partition, namely a first principal vaporization chamber which is supplied with water through a first opening of the cap by means of a valve with a first water injection device actuable by a user, said valve being mounted in a distribution chamber closed by a cover and having an inlet opening connected to a principal water reserve and which is in communication with the steam outlet openings provided in the sole, and a second vaporization chamber which is supplied with water by means of a second water injection device actuable by a user having, on the one hand, an opening connected to a channel connected to the principal water reservoir and, on the other hand, a tube for supplying water from the second water injection device and opening into the second vaporization chamber through a second opening provided in the cap.

Electric steam irons of this type are used as desired for dry ironing or steam ironing. During steam ironing, two choices are provided the user, either a first choice in the course of which the sole of the iron is used in a horizontal plane and for which the user acts on the first water injection device, or a second choice in which the sole of the iron is used in a vertical plane and in which the user acts on the second water injection device.

When the sole of the iron is used in a vertical plane, the distribution chamber empties completely into the principal water reservoir. The second water injection device can therefore only be supplied from said principal reservoir. This arrangement thus requires complicated and troublesome devices and requires the use of numerous sealing joints.

The object of the invention is to overcome the mentioned drawbacks by providing a new structure for the distribution chamber of the electric steam iron so as, on the one hand, to simplify the operations inherent in assembling said iron and, on the other hand, to minimize the cost by mass production.

According to the invention, the distribution chamber comprises two compartments separated in part by a partition whose upper edge is in sealed contact with the cover, namely a first compartment connected to the inlet orifice of the reservoir and through which passes the valve of the first water injection device, and a second compartment communicating with the first compartment through a throat and adapted to constitute a water reserve when the iron is used with the sole in a vertical plane, and into which is immersed, through the cover, the channel of the second water injection device.

Thanks to the new structure of the distribution chamber, the number of pieces used about the two water distribution devices is decreased, which on the one band limits the size of the interior of the iron as well as the number of sealing joints and, on the other hand, simplifies the fabrication of said iron. Moreover, when the sole of the iron is used in a vertical plane, the water reserve provided in the distribution chamber constitutes a water reserve independent of the principal water reservoir and whose volume of water is sufficiently great for the needs of the user.

Figure 2:
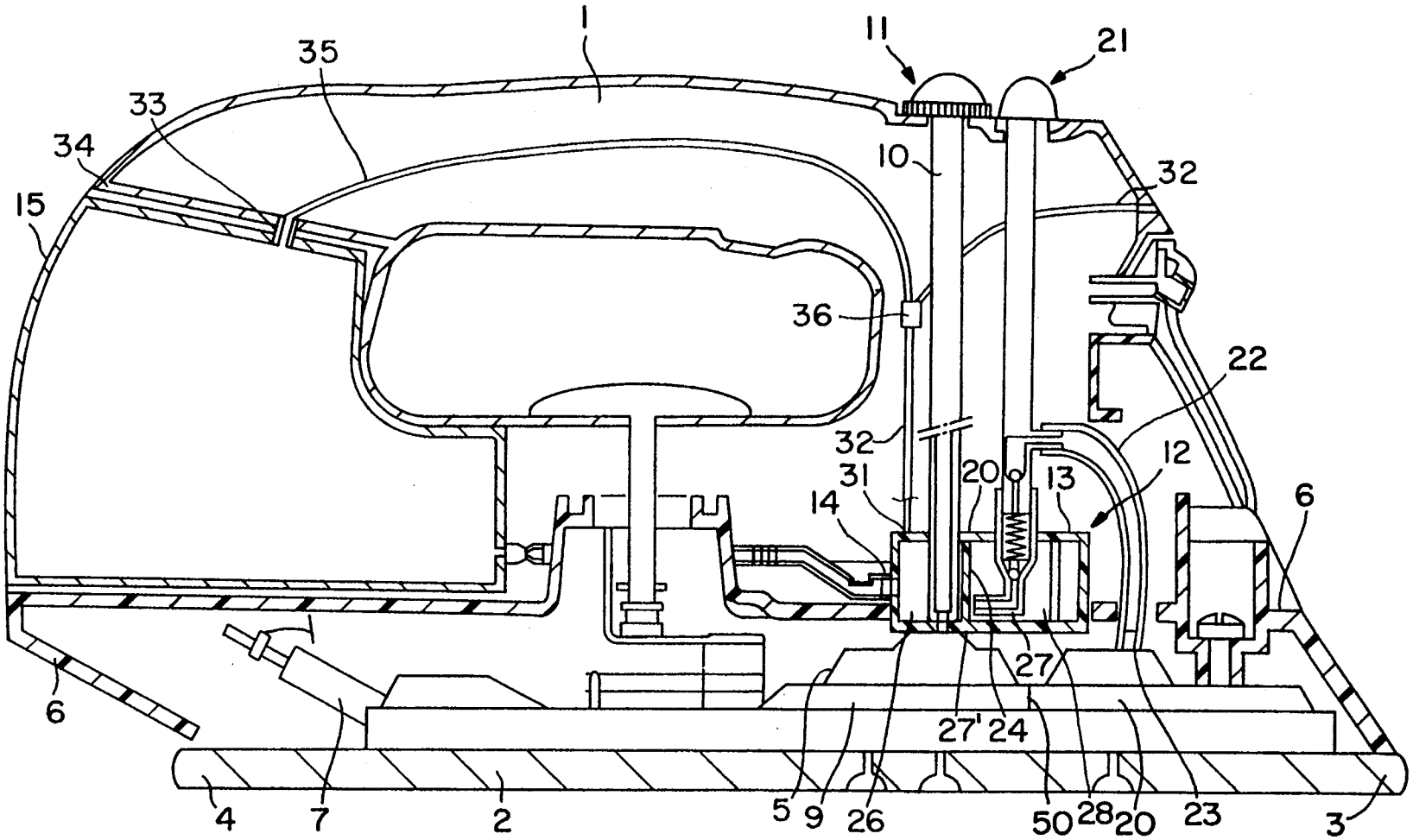
Figure 3:
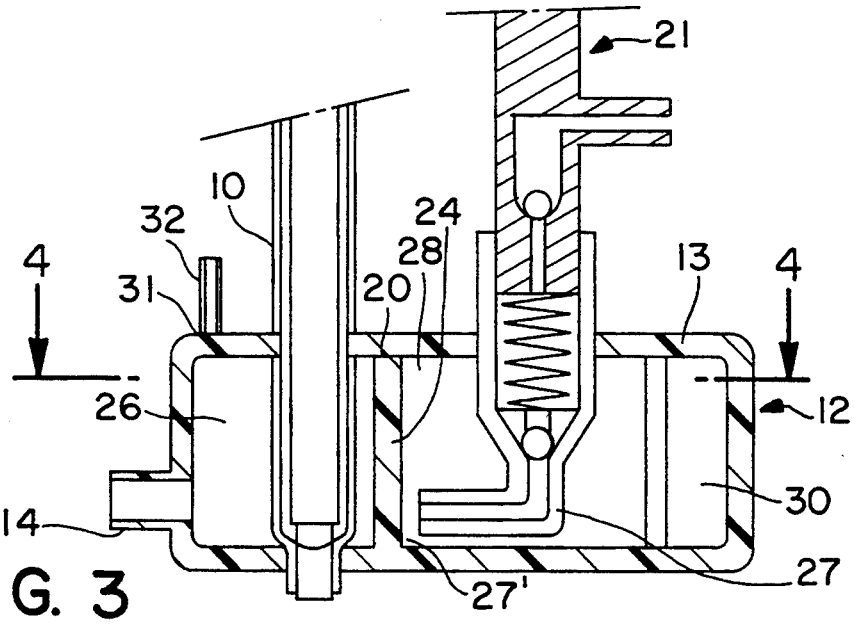
Figure 4:
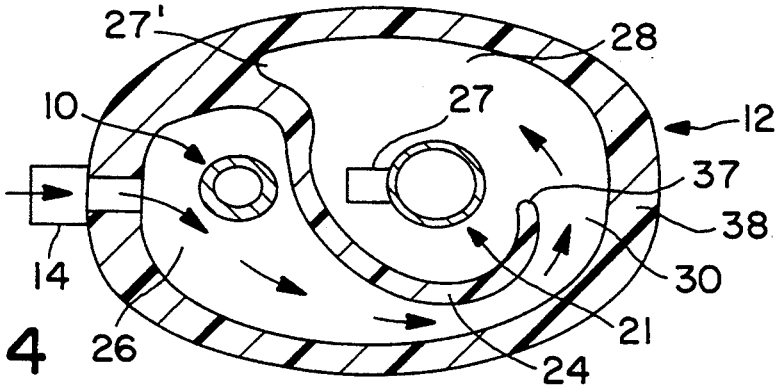
Figure 5:
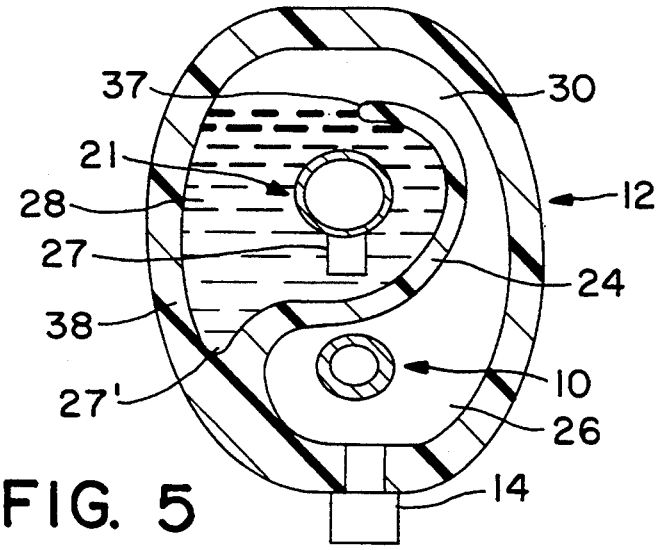
Figure 6:
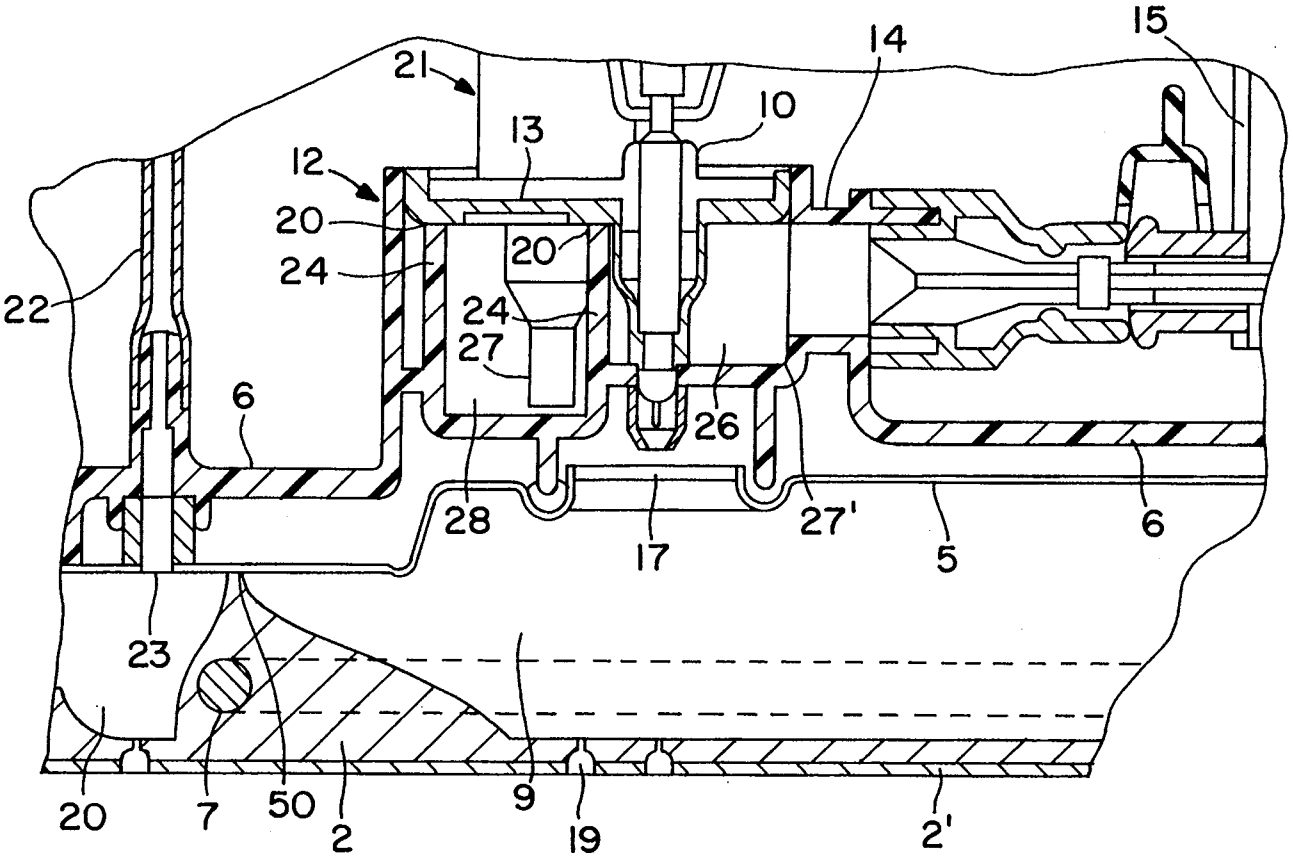

Other characteristics and advantages of the invention will become apparent from the description which follows, by way of non-limiting example, with reference to the accompanying drawings, in which:

FIG. 1 is a cross-sectional schematic view of an iron according to the prior art, FIG. 2 is a cross-sectional schematic view of an iron provided with a distribution chamber according to the invention, FIG. 3 is a cross-sectional view of the distribution chamber according to the invention, FIG. 4 is an elevational cross-sectional view in a horizontal position on the line l-j of FIG. 3, FIG. 5 is an elevational cross-sectional view in vertical position and in which the distribution chamber contains a certain quantity of water, FIG. 6 is a broken away view of the lower portion, enlarged, of the iron provided with a distribution chamber according to the invention and according to another embodiment.

According to FIG. 1, a pressing iron of known type comprises a casing 1 and a sole 2, for example of aluminum, extending longitudinally from a point 3 toward a heel 4. Said sole 2 is separated from the casing 1 by a thermal shield 6, of for example bakelite. The sole 2 comprises a heating element 7 molded into a projection 8 and two vaporization chambers closed by a cap 5 and separated by a partition 50. A first principal vaporization chamber 9 is supplied with water through a first opening 17 of the cap 5 by means of a valve 10 of a first water injection device 11 actuable by a user, said valve 10 being mounted in a distribution chamber 12 closed by a cover 13 and having an inlet opening 14 connected to a principal water reservoir 15. The first principal vaporization chamber 9 is in communication with the lower surface of the sole 2 through steam outlet openings 19 provided in the sole 2, for example adjacent the lateral edges of said sole 2. A second vaporization chamber 20 disposed in the forward region of the sole is supplied with water by a second water injection device 21 actuable by a user having, on the one hand, an opening 27 connected to a channel 29 connected to the principal water reservoir 15 at 29 and, on the other hand, a water supply tube 22 emerging from the second water injection device 21 and opening into the second vaporization chamber 20 through a second opening 23 provided in the cap 5.

The water injection devices 11 and 21 are known types of water injection devices. The distribution chamber 12 is generally formed in a body produced by molding of an elastomer, preferably a silicone, adapted to resist the temperature of the cap of the sole on which it rests.

According to FIG. 2, the distribution chamber 12 comprises two compartments separated in part by a partition 24 whose upper edge 20 is in sealed contact with the cover 13, namely a first compartment 26 connected to the inlet opening 14 and through which passes the valve 10 of the first water injection device 11, and a second compartment 22 communicating with the first compartment 26 through at least one throat 30 and adapted to constitute a water reserve when the iron is used with the sole in a vertical plane and into which is immersed, through the cover 13, the opening 27 of the second water injection device 21.

The second compartment 28 has the general shape of a pocket whose bottom 27' is oriented toward the heel 4 of the pressing iron.

The distribution chamber 12 comprises, moreover, a hole 31 opening into the first compartment 26 of said distribution chamber 12 and adapted to the operation of the second water injection device 21 when the iron is used with the sole 2 in a vertical plane.

In the embodiment shown in FIG. 2, a hole 31 is provided in the cover 13 of the distribution chamber 12 and is connected by a channel 32 to the exterior of the casing 1 of the iron. The principal water reservoir 15 comprises a hole 33 provided in its upper portion 34 and connected, by a channel 35, to the channel 32 by a connector 36.

In this way, the water flows easily from the principal water reservoir 15 toward the distribution chamber 12. As shown in FIGS. 3 and 4 in which all the reference numerals correspond to those of the elements shown in FIGS. 1 and 2, the partition 24 has the general shape of a hook whose free end 37 forms with the adjacent wall 38 of the chamber 12 the throat 30 and whose foot is connected to the wall 38 of the distribution chamber 12. The wall 38 has, for example, an ovoidal shape. Numerous shapes of partition could be envisaged.

When the distribution chamber 12 is connected to the principal water reservoir 15, water penetrates said distribution chamber 12 through the inlet opening 14 and flows along a filling circuit shown by the arrows in FIG. 4. Thus, water is distributed into the two compartments 26 and 28 of the vaporization chamber 12.

According to FIG. 5, the iron being used with its sole in a vertical plane, the distribution chamber 12 is located in a vertical position. The distribution chamber 12, initially filled with water before the movement of the sole of the iron into a vertical plane, partially empties. The water contained in the first compartment 26 flows through the opening 14 toward the principal water reservoir 15 (not shown in this figure) while the water contained in the second compartment 28 is stopped by the partition 24. As a result, the user can freely actuate the second water injection device 21 and use the iron according to the second choice, corresponding to vertical ironing used generally for fragile cloth.

In a preferred embodiment shown in FIG. 6, in which a sole plate 2 is shown having a bottom 2', the distribution chamber 12 is of one piece with the thermal shield 6. Thanks to this new structure of the thermal shield, the number of pieces used for the production of an electric steam iron is decreased, which on the one hand facilitates assembly of said iron and, on the other hand, reduces the cost of such an iron.

What is claimed is:

1. In an electric steam iron comprising a casing (1) and a sole (2) extending longitudinally from a point (3) toward a heel (4) of the iron and separated from the casing (1) by a thermal shield (6), the sole (2) comprising a heating element (7) and two vaporization chambers closed by a cap (5) and separated by a partition (50), a first of said chambers comprising a principal vaporization chamber (9) which is supplied with water through a first opening (17) in the cap (9) by means of a valve (10) of a first water injection device (11) actuable by a user, said valve (10) being mounted in a distribution chamber (12) closed by a cover (13) and having an inlet opening (14) connected to a principal water reservoir (15), and which is in communication with steam outlet openings (19) provided in the sole (2), a second of said two chambers comprising a chamber (20) which is supplied with water by a second water injection device (21) actuable by a user, said second chamber having, on the one hand, an opening (27) connected to the principal water reservoir (15) and, on the other hand, a water supply tube (22) emerging from the second water injection device (21) and opening into the second vaporization chamber (20) through a second opening (23) provided in the cap (5); the improvement wherein the distribution chamber (12) comprises two compartments (26, 28) separated in part by a partition (24) whose upper edge (20) is in sealed contact with the cover (13), a first of said compartments (26) being connected to the inlet opening (14) of the reservoir (15) and through which passes the valve (10) of the first water injection device (11), and a second of said compartments (28) communicating with the first compartment (26) by means of throat (30) and being adapted to constitute a water reservoir when the iron is used with the said sole in a vertical plane, and into which is immersed, through the cover (13), the opening (27) of the second water injection device (21).

2. An electric steam iron according to claim 1, wherein the second compartment (28) has the shape of a pocket whose bottom (27') is oriented toward the heel (4).

3. An electric steam iron according to claim 1, wherein the distribution chamber (12) includes a hole (31) opening into the first compartment (26) of said distribution chamber (12).

4. An electric steam iron according to claim 3, wherein said hole (31) is in the cover (13) of the distribution chamber (12) and is connected by a channel (32) to the exterior of the casing (1) of the iron.

5. An electric steam iron according to claim 1, wherein the partition (24) has the shape of a hook whose free end forms, with the adjacent wall (38) of the chamber (12), the throat (30) and whose foot (39) is connected to the wall (38) of the distribution chamber (12).

6. An electric steam iron according to claim 1, wherein the two water injection devices (11, 21) are located on opposite sides of the partition (24).

7. An electric steam iron according to claim 5, wherein the wall (38) of the distribution chamber (12) is of ovoidal shape.

8. An electric steam iron according to claim 1, wherein the distribution chamber (12) is of one piece with the thermal shield (6).

* * * * *